US009719404B2

(12) United States Patent
Yamamoto et al.

(10) Patent No.: US 9,719,404 B2
(45) Date of Patent: Aug. 1, 2017

(54) MUFFLER AND ITS CORRESPONDING MANUFACTURING METHOD

(71) Applicant: TOYOTA JIDOSHA KABUSHIKI KAISHA, Toyota-shi, Aichi-ken (JP)

(72) Inventors: Akiyoshi Yamamoto, Nisshin (JP); Kenji Shikata, Nagoya (JP); Ken Miwa, Nagoya (JP); Koichi Hiramatsu, Toyota (JP); Isao Nojiri, Nisshin (JP); Tomoyuki Fujita, Nagoya (JP); Kazuki Sugi, Nagakute (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 0 days.

(21) Appl. No.: 14/782,852

(22) PCT Filed: Apr. 9, 2014

(86) PCT No.: PCT/IB2014/000506

§ 371 (c)(1),
(2) Date: Oct. 7, 2015

(87) PCT Pub. No.: WO2014/167402

PCT Pub. Date: Oct. 16, 2014

(65) Prior Publication Data

US 2016/0053664 A1 Feb. 25, 2016

(30) Foreign Application Priority Data

Apr. 10, 2013 (JP) ..... 2013-081960
Feb. 6, 2014 (JP) ..... 2014-021350

(51) Int. Cl.
*F01N 13/08* (2010.01)
*B23P 11/00* (2006.01)
(Continued)

(52) U.S. Cl.
CPC ..... *F01N 13/1872* (2013.01); *F01N 1/00* (2013.01); *F01N 13/18* (2013.01);
(Continued)

(58) Field of Classification Search
CPC .... F01N 13/1827; F01N 13/1872; F01N 1/00; F01N 13/18; F01N 2450/20;
(Continued)

(56) References Cited

U.S. PATENT DOCUMENTS 1,694,862 A * 12/1928 Lindgren ..... B21D 51/28 72/382
2,429,141 A * 10/1947 Taylor ..... F21V 11/00 362/217.03
(Continued)

FOREIGN PATENT DOCUMENTS

FR 2319012 A1 2/1977
JP 62-185820 U1 11/1987
(Continued)

*Primary Examiner* — Sarang Afzali
*Assistant Examiner* — Darrell C Ford
(74) *Attorney, Agent, or Firm* — Andrews Kurth Kenyon LLP

(57) ABSTRACT

A manufacturing method for a muffler includes: a trimming step, of cutting out a dogleg shaped muffler body member; a bending processing step of processing the muffler body member into a tube by advancing the muffler body member between an upper roller and a lower roller of a bending machine while adjusting an advancing direction with a guide and by changing a relative position of the upper roller and the lower roller; a first joining step of joining two ends of the tubularly-processed muffler body member in a long side direction; an insertion step of inserting an inner structural member into the inside of the tubularly-processed muffler body member; a second joining step of joining caps to opening portions of the tubularly-processed muffler body
(Continued)

member; and a third joining step of joining an air intake joint and an exhaust pipe to the sealed muffler body member.

2 Claims, 15 Drawing Sheets

(51) Int. Cl.

| | |
|---|---|
| ***B21D 39/00*** | (2006.01) |
| ***B23P 17/00*** | (2006.01) |
| ***B21D 51/16*** | (2006.01) |
| ***F01N 13/18*** | (2010.01) |
| ***F01N 1/00*** | (2006.01) |
| *B21D 51/28* | (2006.01) |

(52) U.S. Cl.
CPC ..... *F01N 2450/20* (2013.01); *F01N 2470/06* (2013.01); *F01N 2470/10* (2013.01); *F01N 2490/16* (2013.01)

(58) Field of Classification Search
CPC ..... F01N 2470/06; F01N 2470/10; F01N 2490/16; F01N 13/1861; F01N 13/1888
USPC ..... 29/515, 516, 517, 890.08; 181/227, 282; 72/51, 52
See application file for complete search history.

(56) References Cited

U.S. PATENT DOCUMENTS 4,333,545 A * 6/1982 Roberts ..... F01N 13/185 138/151
4,513,596 A * 4/1985 Usher ..... B21C 37/108 72/206
4,706,488 A * 11/1987 Williamson ..... B21D 5/143 72/133
5,911,457 A * 6/1999 Hultberg ..... B21C 37/123 29/890.053
6,050,700 A * 4/2000 Satterfield ..... F21S 8/031 362/216
6,233,993 B1 * 5/2001 Irie ..... B21D 41/04 72/121
6,283,162 B1 * 9/2001 Butler ..... B60K 13/04 138/109
6,351,978 B1 * 3/2002 Kusakabe ..... B21D 5/12 72/52
6,415,887 B1 * 7/2002 Moran ..... F01N 1/00 181/224
6,622,821 B2 * 9/2003 Butler ..... F01N 1/08 138/109
7,243,757 B2 * 7/2007 Stuber ..... F01N 1/02 181/249
7,523,554 B2 * 4/2009 Kimura ..... B21D 53/30 228/158
7,669,448 B1 * 3/2010 Gharib ..... B21C 37/0815 72/213
9,488,079 B2 * 11/2016 Bartlett ..... F01N 13/1872
2003/0042071 A1 * 3/2003 Butler ..... F01N 1/08 181/270
2003/0154600 A1 * 8/2003 Umeda ..... B21C 37/065 29/890
2004/0011105 A1 * 1/2004 Nakamura ..... B21D 22/14 72/121
2004/0148992 A1 * 8/2004 Huang ..... B21C 37/101 72/51
2006/0037811 A1 * 2/2006 Kensok ..... F01N 1/083 181/249
2006/0236737 A1 * 10/2006 Shitamoto ..... B21C 37/08 72/51
2007/0051558 A1 * 3/2007 Okawara ..... F01N 1/084 181/282
2007/0116617 A1 * 5/2007 Lawrukovich ..... F01N 3/2839 422/179
2008/0053748 A1 * 3/2008 Emler ..... F01N 1/003 181/212
2008/0127699 A1 * 6/2008 Okada ..... B21D 22/14 72/121
2008/0251314 A1 * 10/2008 Mizutani ..... F01N 1/02 181/251
2009/0014082 A1 * 1/2009 Cannaley ..... B21D 41/04 138/177
2010/0140014 A1 * 6/2010 Han ..... F01N 1/084 181/254
2010/0193285 A1 * 8/2010 Mori ..... F01N 13/1811 181/282
2010/0269495 A1 * 10/2010 Muller ..... F01N 13/18 60/324
2011/0086751 A1 * 4/2011 Gharib ..... B21D 39/02 493/162
2012/0297624 A1 * 11/2012 He ..... B21D 5/08 29/898.04
2013/0340879 A1 * 12/2013 Oh ..... B21D 5/086 138/140
2014/0196978 A1 * 7/2014 Hartmann ..... F02M 35/1036 181/229
2015/0321236 A1 * 11/2015 Homma ..... B21D 5/14 72/173
2015/0321240 A1 * 11/2015 Yamamoto ..... B21D 41/045 72/111
2015/0322831 A1 * 11/2015 Yamamoto ..... F01N 1/08 181/227
2015/0322842 A1 * 11/2015 Homma ..... B21D 5/12 29/890.08
2015/0343509 A1 * 12/2015 Homma ..... B21D 5/14 29/890.08
2016/0245146 A1 * 8/2016 Hayama ..... F01N 13/007

FOREIGN PATENT DOCUMENTS

JP 03-066416 A 3/1991
JP 2000-104529 A 4/2000
JP 2002-195925 A 7/2002
JP 2004-036528 A 2/2004
JP 2005169486 A 6/2005
JP 2006-159251 A 6/2006

* cited by examiner

MUFFLER AND ITS CORRESPONDING MANUFACTURING METHOD

CROSS-REFERENCE TO RELATED APPLICATIONS

This is a national phase application based on the PCT International Patent Application No. PCT/IB2014/000506 filed Apr. 9, 2014, claiming priority to Japanese Patent Application Nos. 2013-081960 and 2014-021350 filed Apr. 10, 2013 and Feb. 6, 2014, respectively, the entire contents of all of which are incorporated herein by reference.

BACKGROUND OF THE INVENTION

1. Field of the Invention

The invention relates to a method of manufacturing a muffler and a muffler, in particular, a muffler having a round-cornered polygonal tubular shape and a method of manufacturing a muffler.

2. Description of Related Art

In recent years, a muffler mounted on a vehicle body is required to be able to easily mount while improving performance. Further, the muffler is required to be low cost. Thus, Japanese Patent Application Publication No. 2004-36528 (JP 2004-36528 A) discloses a conventional muffler and an example of a method of manufacturing the same.

JP 2004-36528 A discloses an exhaust muffler that uses a rolled titanium material and a method of manufacturing the same. According to JP2004-36528 A, an inner cylinder member and an outer cylinder member formed by trimming a band of rolled titanium material in a rolled fashion into a predetermined dimension, followed by rolling machining form a muffler. At this time, according to JP2004-36528 A, the inner cylinder member and the outer cylinder member are processed by the rolling machine in a substantially vertical direction to a rolling direction of the rolled titanium material to form a muffler.

However, according to a conventional muffler and a method of manufacturing the same, there was a problem that difficulty during mounting, such as interference between a muffler to be manufactured and a vehicle body, cannot be avoided, because it is difficult to form the muffler so that a shape of a side surface of the muffler fits a vehicular frame.

SUMMARY OF THE INVENTION

The present invention provides a muffler that can be easily mounted on a vehicle body and a method of manufacturing a muffler that can be manufactured with simple steps.

A first aspect of the invention relates to a manufacturing method for a muffler, the method including: a trimming step of cutting out a dogleg shaped muffler body member from a planar plate; a bending processing step of processing the muffler body member into a tube by advancing the muffler body member between an upper roller and a lower roller of a bending machine while adjusting an advancing direction with a guide and by changing a relative position of the upper roller and the lower roller; a first joining step of joining two ends of the tubularly-processed muffler body member in a long side direction of the dogleg shaped muffler body member; an insertion step of inserting an inner structural member into the inside of the tubularly-processed muffler body member; a second joining step of joining caps to opening portions of the tubularly-processed muffler body member to seal the tubularly-processed muffler body member; and a third joining step of joining an air intake joint and an exhaust pipe to the sealed muffler body member.

A second aspect of the invention relates to a muffler that includes: an upper surface part, a lower surface part, a side surface that is formed with a curved surface or a flat surface, and joins the upper surface and the lower surface; a first sealing part that seals one opening portion of a tubular member that is formed with the upper surface part, the lower surface part, and side surface part, and a second sealing part that seals the other opening portion of the tubular member, in which the upper surface part, the lower surface part and the side surface part are formed from a sheet of flat plate member and the first sealing part and the second sealing part has a different shape each other.

According to the above manufacturing method for the muffler, it is easy to manufacture the muffler wherein at least one of a side surface, an upper surface portion, and an under surface portion of the tubular member of the muffler is inclined. Therefore, according to the muffler of the present invention, even if a space between vehicular frames has an inclined shape, it is possible to fit the muffler to the space between the vehicular frames while interference between the muffler and the vehicular frame is avoided.

According to the invention, a muffler that can readily be mounted on a vehicle body can be manufactured according to simple steps.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, embodiments of the invention will be described with reference to the drawings. A muffler according to embodiments of the invention is mounted on a vehicle body of a vehicle.

Figure 1:
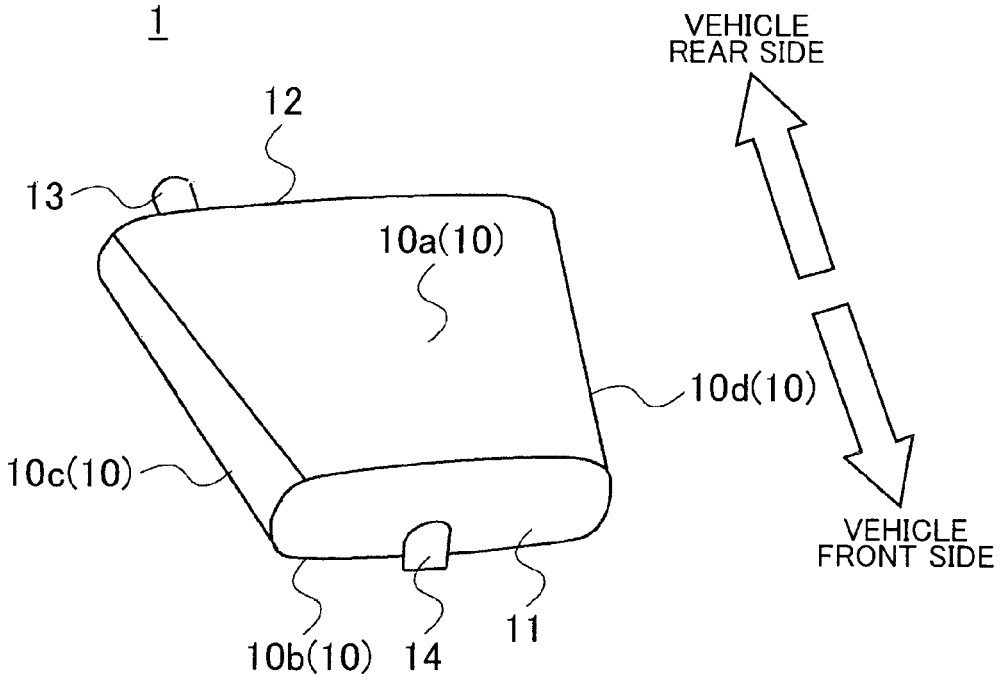
FIG. 1 is a schematic diagram that shows a shape of a muffler according to the first embodiment.

FIG. 1 is a schematic diagram that shows a shape of a muffler 1 of the first embodiment. As shown in FIG. 1, the muffler 1 of the first embodiment includes a tubular member 10, a first sealing part 11, a second sealing part 12, an exhaust pipe 13, and an air intake joint 14. The tubular member 10 is formed with an upper surface part 10*a*, a lower surface part 10*b*, and side surface parts 10*c* and 10*d*.

The tubular member 10 has the upper surface part 10*a* and the lower surface part 10*b* formed into a flat surface, and side surface parts 10*c* and 10*d* formed into a curved surface. The upper surface part 10*a* and the lower surface part 10*b* are connected with the side surface part 10*c* and the side surface part 10*d*. The tubular member 10 is formed from a sheet of a flat plate member. Further, in the muffler 1 of the first embodiment, the upper surface part 10*a* and the lower surface part 10*b* each has a trapezoidal shape. According to the embodiment, the upper surface part 10*a* and the lower surface part 10*b* each has a flat surface. However, the flat surface may have a slight curvature as long as it is more flat than the side surface parts 10*c* and 10*d*. Further, each of the flat surface and the curved surface may have a slight irregularity.

The first sealing part 11 blocks an opening portion in a front side of a vehicle body among front and rear opening portions of the tubular member 10. The second sealing part 12 blocks an opening portion in a rear side of a vehicle body among front and rear opening portions of the tubular member 10. A width of the first sealing part 11 in a horizontal direction (in the direction in a vehicle width) is larger than a width of the second sealing part 12 in a horizontal direction. Further, a width of the first sealing part 11 in a vertical direction (in the height direction of the vehicle) on a front side of the sealing part 11 is narrower than a width of the second sealing part in a vertical direction. In other words, the first sealing part 11 and the second sealing part 12 each has a shape different from the other.

The exhaust pipe 13 is attached to the second sealing part 12. The air intake joint 14 is attached to the first sealing part 11. That is, the muffler 1 takes in the exhaust gas flowing-in from the vehicle front side through the air intake joint, and discharges it through the exhaust pipe 13 toward the vehicle rear side.

Figure 2:
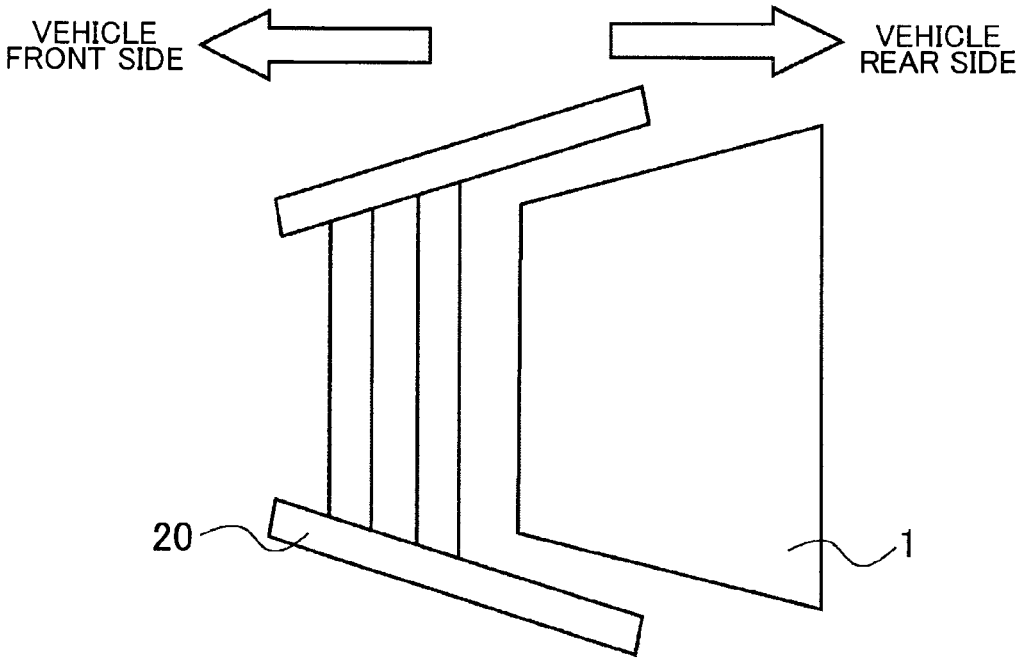
FIG. 2 is a schematic diagram that describes a mounting position of the muffler according to the first embodiment.

Subsequently, a method of mounting the muffler 1 of the first embodiment on a vehicle body will be described. FIG. 2 is a schematic diagram that describes a mounting position of the muffler 1 of the first embodiment. FIG. 2 shows a view of a vehicle body when viewed from above. As shown in FIG. 2, the vehicle body generally includes a rear suspension member 20 disposed corresponding to positions of a rear tire and a rear suspension. The rear suspension member 20 has a trapezoidal clearance. Here, since the muffler 1 of the first embodiment has a trapezoidal shape when viewed from above, the muffler 1 of the first embodiment can be installed in the clearance without interfering with the rear suspension member 20.

Figure 3:
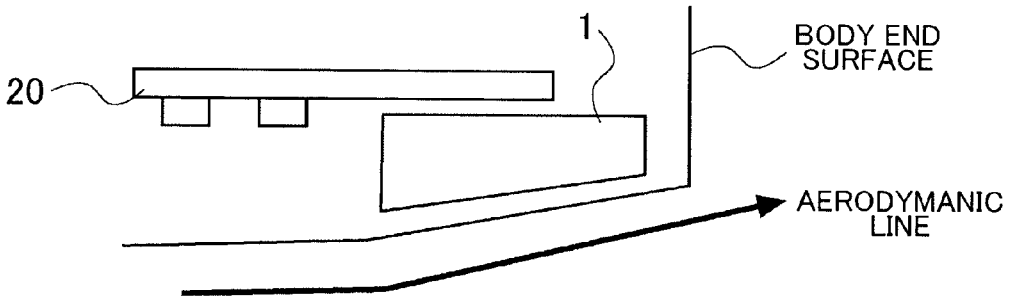
FIG. 3 is a schematic diagram that describes a mounting position of the muffler according to the first embodiment.

FIG. 3 is a schematic diagram that describes a mounting position of the muffler 1 of the first embodiment. FIG. 3 is a side view of the vehicle body. The muffler 1 of the first embodiment has a vehicle front side height (a width of the first sealing part 11 in a vertical direction) higher than a vehicle rear side height (a width of the second sealing part 12 in a vertical direction). Therefore, a lower surface of the muffler 1 can be housed inside a body end face. Thus, the muffler 1 can reduce pneumatic resistance of the vehicle body without disturbing an aerodynamic line of a body lower surface.

As described above, when the muffler 1 of the first embodiment is used, while avoiding an interference with structural members in the proximity of the muffler arranging position such as the rear suspension member 20, the muffler can be readily installed. Further, when the muffler 1 of the first embodiment is used, since the muffler can be installed inside a body end surface, an air flow on a lower surface of the vehicle body can be improved and aerodynamic performance can be improved. Further, since the muffler 1 of the first embodiment has a trapezoidal shape when viewed from above, even when an object is present, the muffler can be disposed so as to come around behind the intervention. Still further, since the muffler 1 of the first embodiment can be disposed by utilizing the clearance to the maximum, a large capacity muffler can be achieved. Thus, when the muffler capacity is made larger, effects such as noise reduction and an improvement in an engine output can be obtained.

Figure 4:
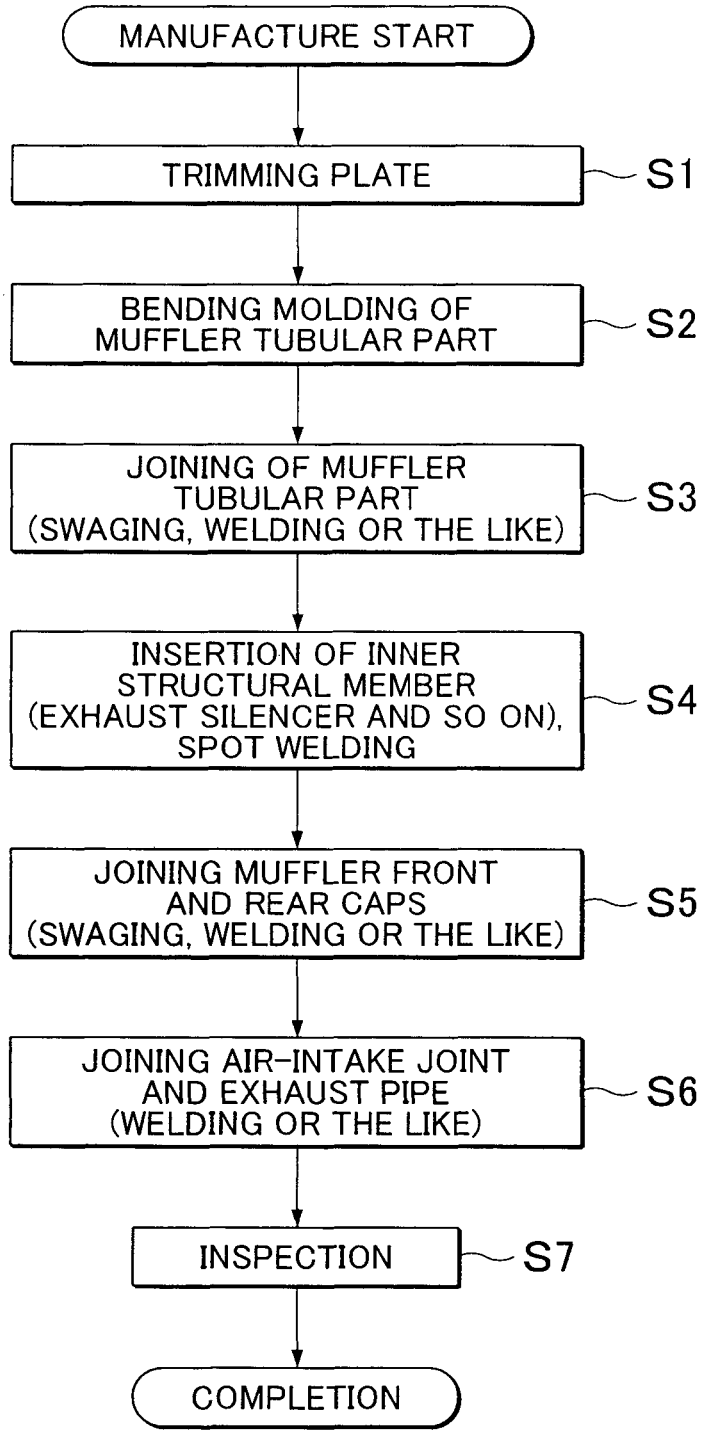
FIG. 4 is a flowchart of a muffler manufacturing method according to the first embodiment.

According to the invention, also in a manufacturing step for manufacturing the muffler 1 of the first embodiment, there is a feature different from a shape of the muffler 1. Therefore, a manufacturing method of a muffler will be more detailed hereinafter. Referring to FIG. 4, a flowchart of a muffler manufacturing method of the first embodiment will be described. In the description of the muffler manufacturing method, the steps will be described in more detail by appropriately referencing to separate drawings.

Figure 5:
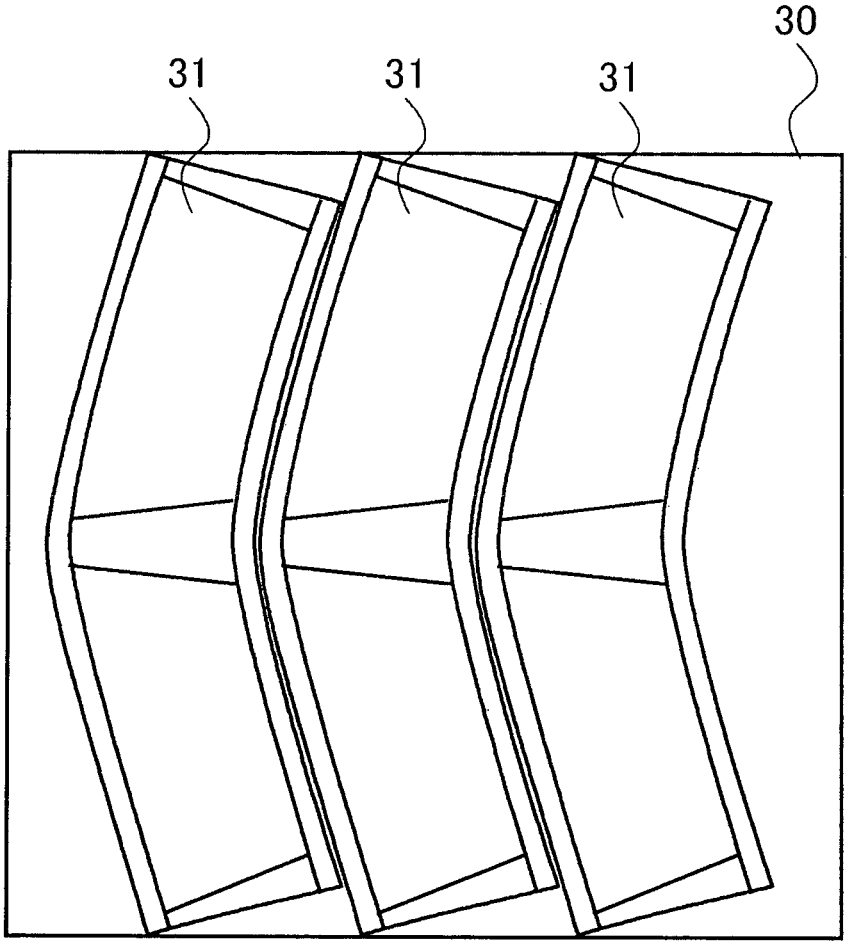
FIG. 5 is a diagram that describes a member cutting out method in a trimming step of the muffler manufacturing method according to the first embodiment.

As shown in FIG. 4, according to a muffler manufacturing method of the first embodiment, a material trimming step for cutting a dogleg-shaped muffler body member from a flat plate is performed (step S1). FIG. 5 is a diagram for describing a member cutting method of a muffler body member in the material trimming step. As shown in FIG. 5, in the material trimming step, a plurality of muffler body members 31 is cut from a sheet of flat plate member 30 by trimming with a blanking mold. At this time, the muffler body member 31 has a dogleg shape. The muffler body member 31 is a member that forms the tubular member 10. When the muffler body member 31 is formed into a dogleg shape, yield of the flat plate member 30 can be improved. For example, a yield higher than that of clam shell type muffler can be realized.

Subsequently, a bending step for performing a bending process to the muffler body member 31 cut in the trimming step is carried out (step S2). In the bending step, the muffler body member 31 is advanced between an upper roller and lower rollers of a bending machine while adjusting an advancing direction with a guide, and by changing a relative position of the upper roller and the lower rollers, the muffler body member 31 is processed into a tube.

Figure 6:
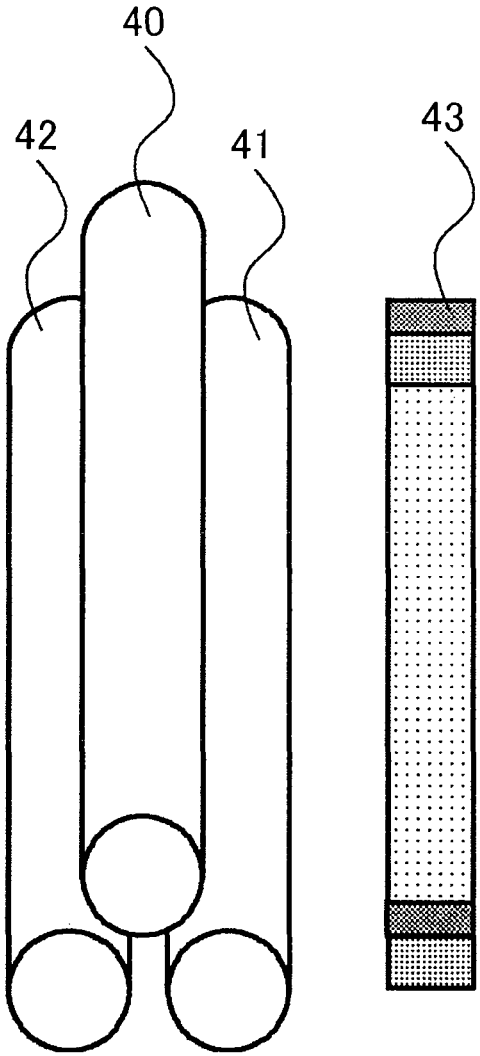
FIG. 6 is a schematic diagram of a bending machine used in in the bending processing step of the muffler manufacturing method according to the first embodiment.

Now, FIG. 6 shows a schematic diagram that describes a bending machine used in the muffler manufacturing method of the first embodiment. As shown in FIG. 6, the bending machine includes an upper roller 40, lower rollers 41 and 42, and a guide 43. The bending machine includes also other constituent elements necessary for conveying a member and operating an apparatus, which are not shown in the drawing e.g., a work table, a conveyer and so on. The lower roller 41 is used to transport the muffler body member 31. The lower roller 42 performs a bending process on the muffler body member 31 and is configured to change a relative position with the upper roller 40. The guide 43 has a protrusion at both ends of a bar like member and, when the muffler body member 31 is passed between the projections, an advancing direction of the muffler body member 31 can be changed.

Figure 7:
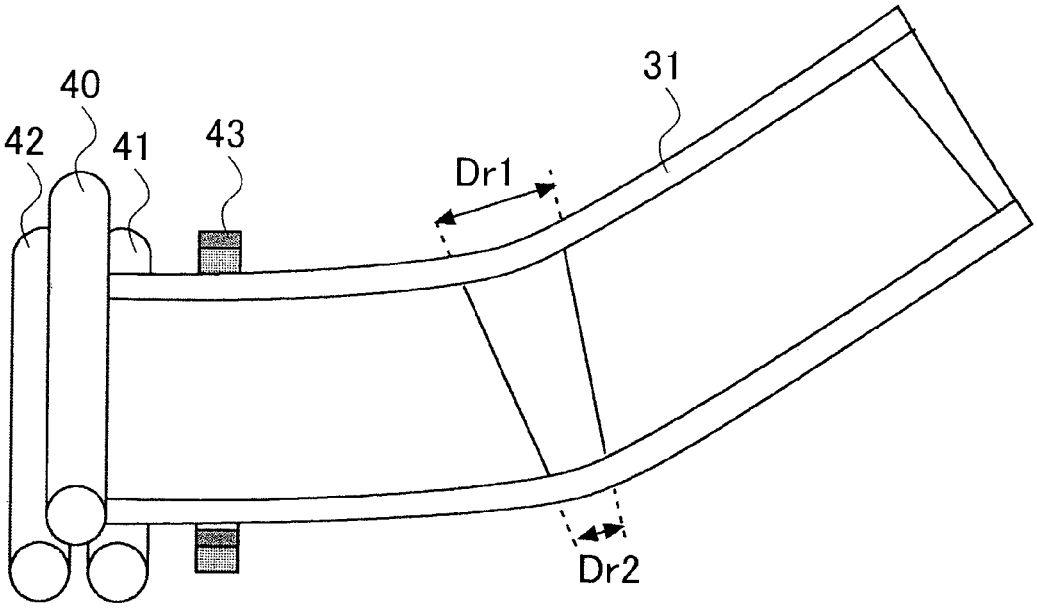
FIG. 7 is a diagram that describes the bending processing step of the muffler manufacturing method according to the first embodiment.
Figure 8:
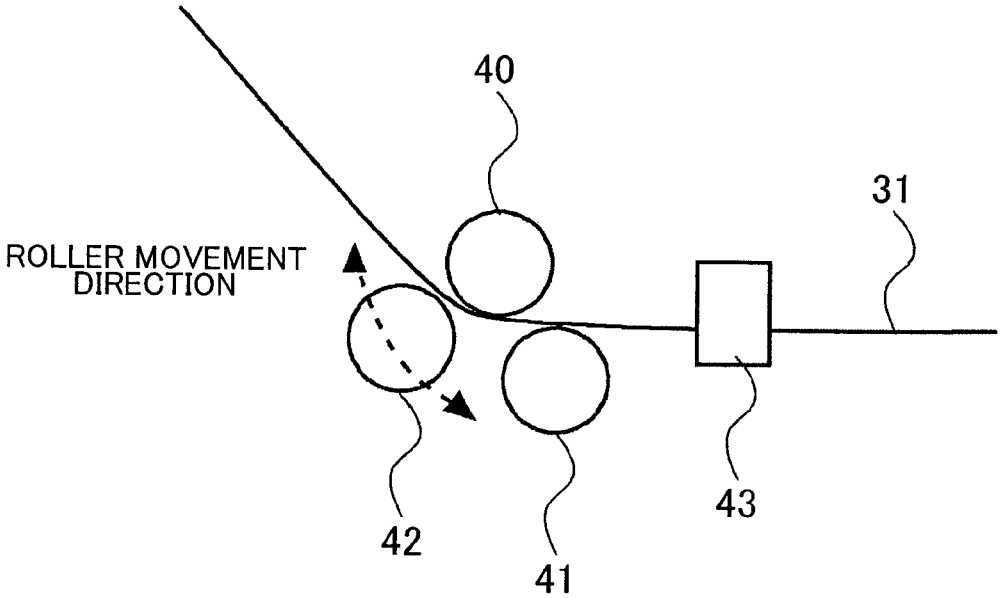
FIG. 8 is a diagram that describes the bending processing step of the muffler manufacturing method according to the first embodiment.

Further, in FIG. 7 and FIG. 8, diagrams for describing a bending step of the muffler manufacturing method of the first embodiment are shown. FIG. 7 describes a step of advancing the muffler body member 31 to the bending machine. As shown in FIG. 7, since the muffler body member 31 has a dogleg shape, a length Dr1 of a bending portion of one side of the muffler body member 31 is different from a length Dr2 of a bending portion of the other side. Therefore, the bending machine adjusts an angle at which the muffler body member 31 advances into the bending machine with the guide 43. Thus, a tubular member 10 of the muffler 1 in which openings each has a different shape can be formed.

Further, FIG. 8 is a diagram that describes a step of bending the muffler body member 31 with the bending machine. As shown in FIG. 8, the bending machine changes a relative position of the lower roller 42 to the upper roller 40, and a curved surface of a side surface of the muffler body member 31 is formed thereby. When forming a flat surface, in the bending machine, horizontal positions of the lower rollers 41 and 42 are set to the same horizontal height.

Subsequently, according to the muffler manufacturing method of the first embodiment, a first joining step of joining two ends of the tubularly-processed muffler body member 31 in a long side direction is performed (step S3). In the joining step, two ends of the muffler body member 31 in the long side direction are joined by using a joining method such as swaging or welding. The swaging, in particular, fixes the ends by applying pressure, and has a merit that the cost is cheap compared with the welding.

Next, according to the muffler manufacturing method of the first embodiment, an insertion step of inserting an inner structural member such as an exhaust silencer or the like into the inside of the tubularly-processed muffler body member 31 is performed (step S4). In the insertion step, the inserted inner structural member is joined to the muffler body member using a joining method such as spot welding and the like.

Subsequently, according to the muffler manufacturing method of the first embodiment, a second joining step for joining caps to the opening portions of the tubularly-processed muffler body member 31 is performed (step S5). In the second joining step, cap members of front and rear of the muffler 1, that is, the first sealing part 11 and the second sealing part 12 are joined with the tubular member 10. In the second joining step, the tubular member 10 and the first sealing part 11 and the second sealing part 12 are joined by means of swaging or welding.

Then, according to the muffler manufacturing method of the first embodiment, a third joining step is performed, in which a member composed with the muffler body member 31, the first sealing part 11 and the second sealing part 12 is joined with the air intake joint 14 and the exhaust pipe 13 (step S6). When the step S6 is performed, the muffler 1 shown in FIG. 1 is completed. Then, as a step S7, the finishing of the muffler 1 completed in the step S6 is inspected, if acceptable, a muffler that can be shipped is completed.

Herein, detailed shapes of the muffler 1 according to the first embodiment will be described with reference to FIG. 9 to FIG. 15. In FIG. 9 to FIG. 15, the exhaust pipe 13 and the air intake joint 14 of which shapes can be optionally set in the muffler 1 according to the first embodiment and a rib that can be formed in the manufacturing process are shown with a dash line. Further, in FIG. 9 to FIG. 15, embossed positions of the tubular member 10, the first sealing part 11 and the second sealing part 12 of which shapes can be optionally set are shown with a dash line.

Figure 9:
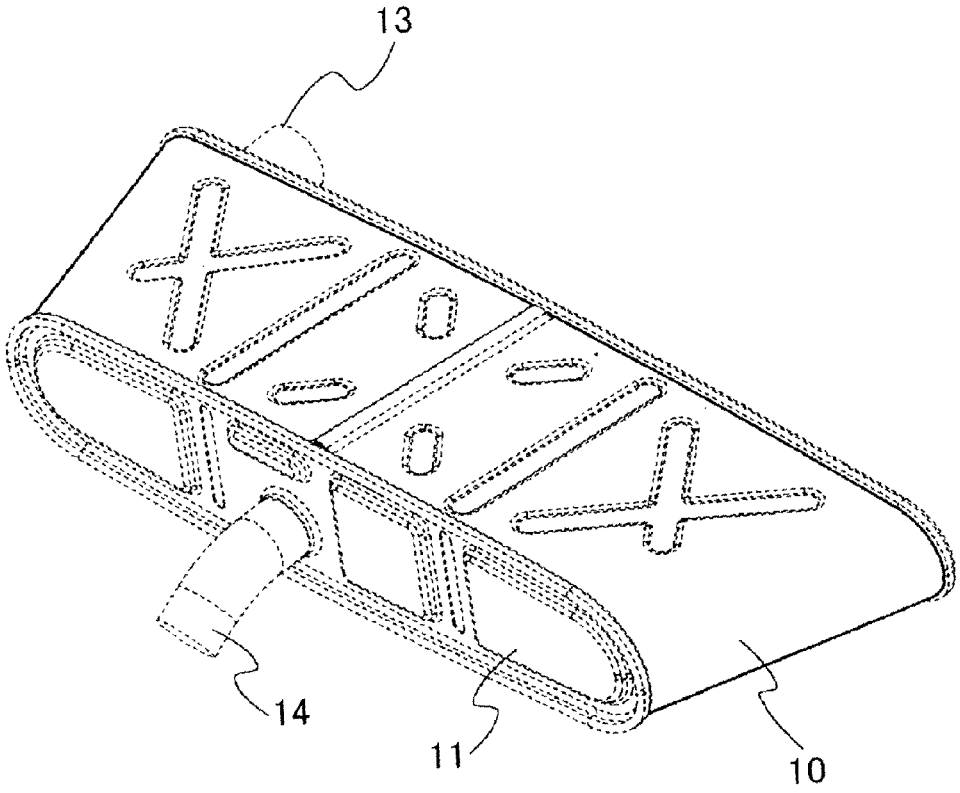
FIG. 9 is a perspective diagram of a muffler according to the first embodiment.
Figure 10:
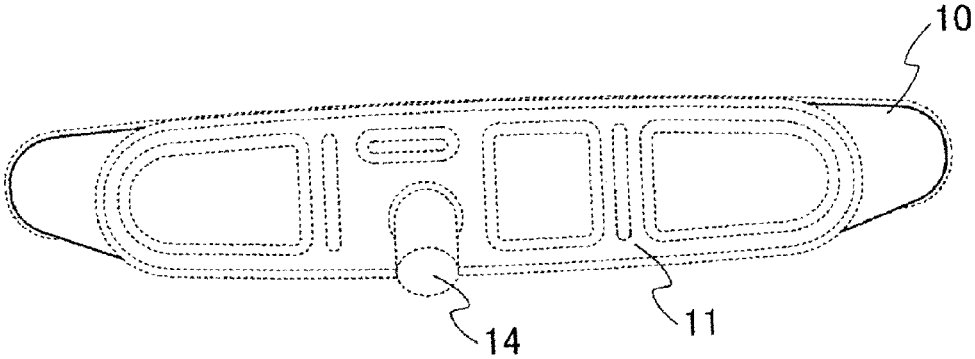
FIG. 10 is a front diagram of the muffler according to the first embodiment.
Figure 11:
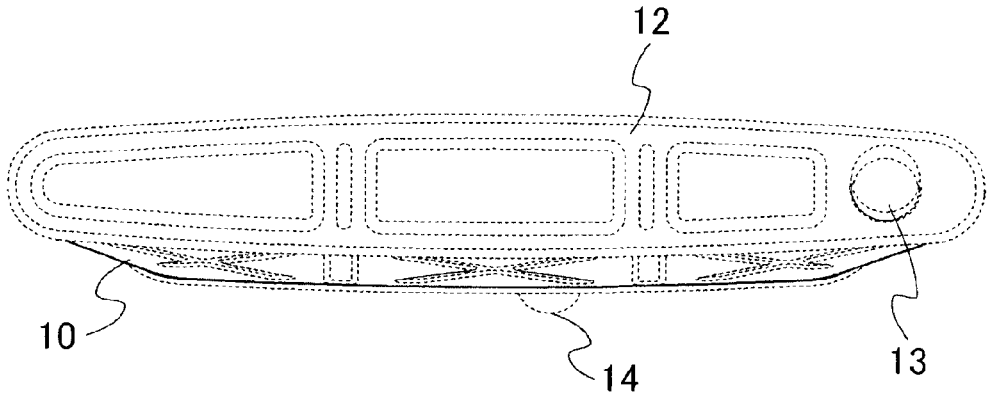
FIG. 11 is a back diagram of the muffler according to the first embodiment.
Figure 12:
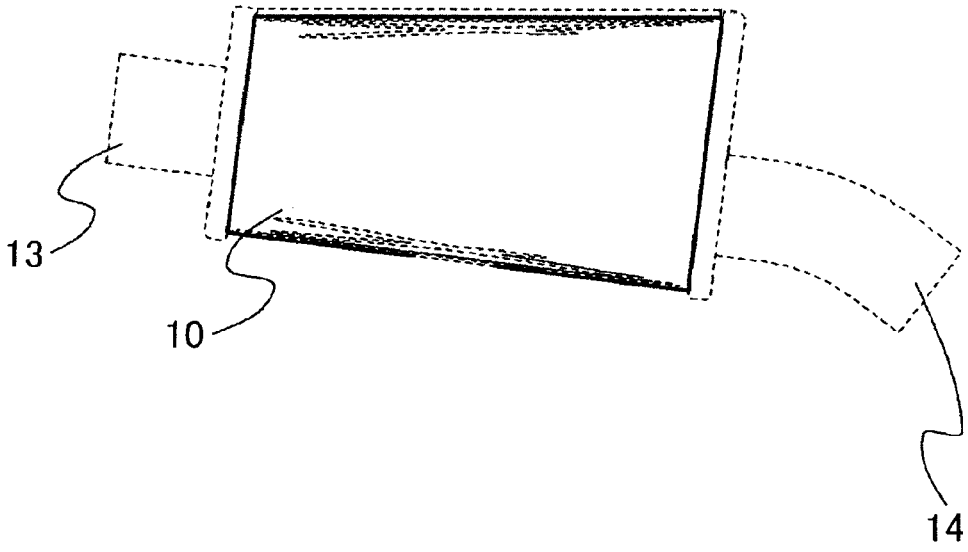
FIG. 12 is a left-side diagram of the muffler according to the first embodiment.
Figure 13:
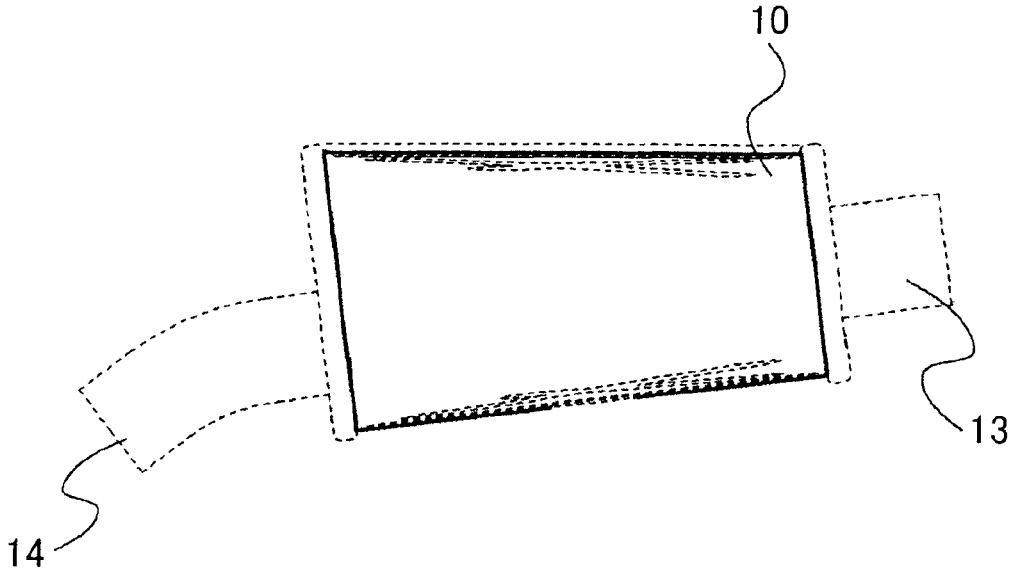
FIG. 13 is a right-side diagram of the muffler according to the first embodiment.
Figure 14:
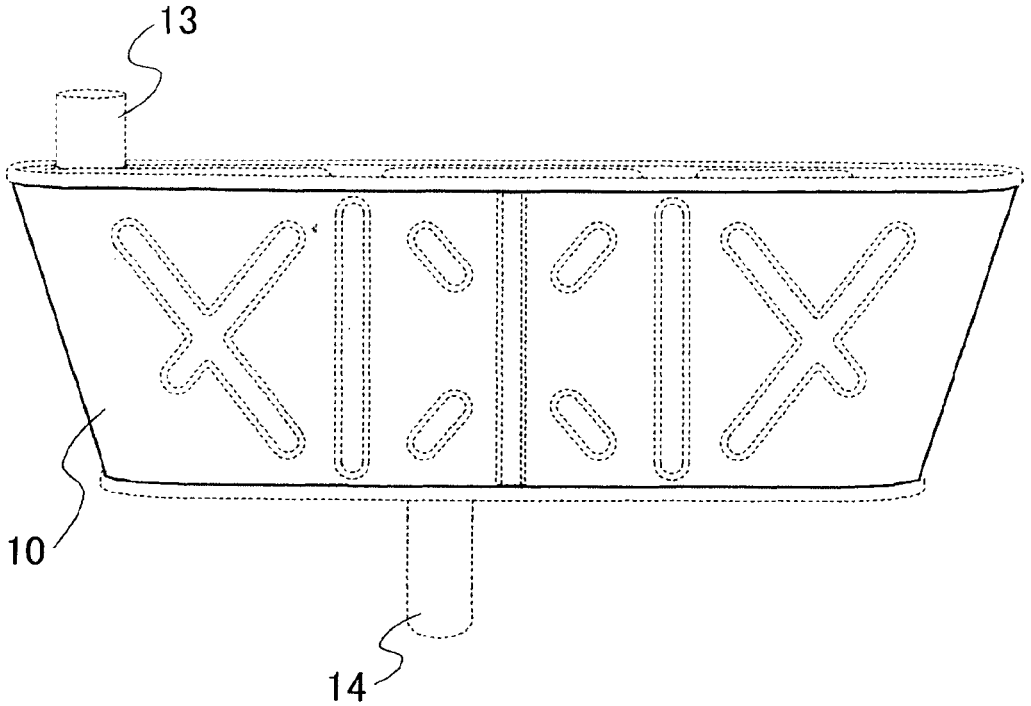
FIG. 14 is a plan diagram of the muffler according to the first embodiment.
Figure 15:
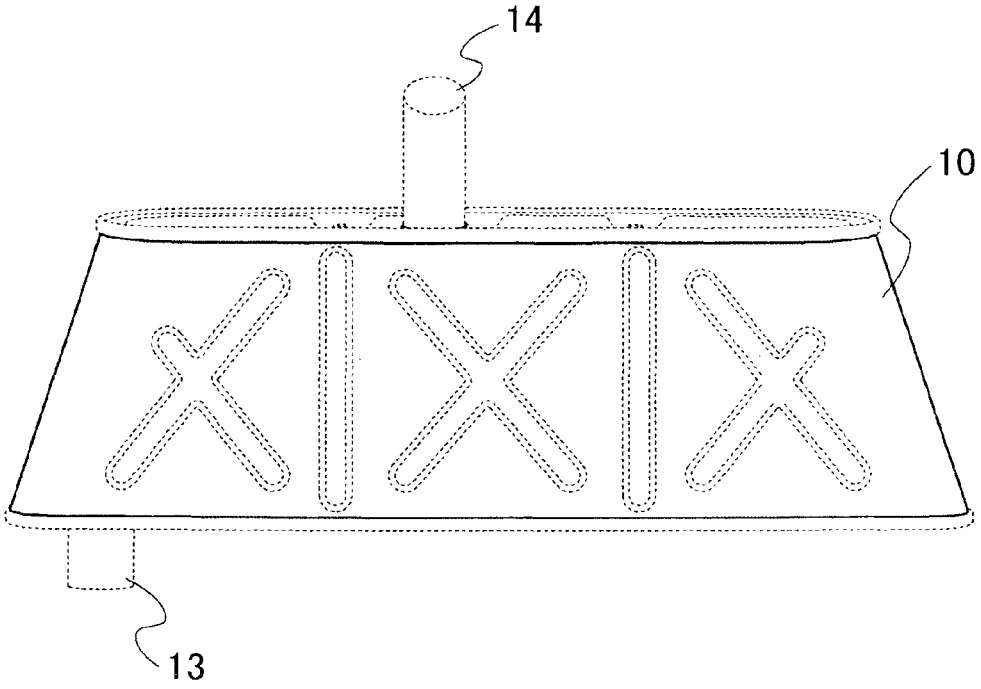
FIG. 15 is a bottom diagram of the muffler according to the first embodiment.

FIG. 9 is a perspective diagram of the muffler 1 according to the first embodiment. FIG. 10 is a front diagram of the muffler 1 according to the first embodiment. FIG. 11 is a back diagram of the muffler 1 according to the first embodiment. FIG. 12 is a left-side diagram of the muffler 1 according to the first embodiment. FIG. 13 is a right-side diagram of the muffler 1 according to the first embodiment. FIG. 14 is a plan diagram of the muffler 1 according to the first embodiment. FIG. 15 is a bottom diagram of the muffler 1 according to the first embodiment.

As shown in FIG. 9 to FIG. 15, the muffler 1 according to the first embodiment has a width (a horizontal direction in the drawing of FIG. 10) of the first sealing part 11 smaller than a width (a horizontal direction in the drawing of FIG. 11) of the second sealing part 12. On the other hand, the muffler 1 according to the first embodiment has a height (a vertical direction in the drawing of FIG. 10) of the first sealing part 11 larger than a height (a vertical direction in the drawing of FIG. 11) of the second sealing part 12. Further, the muffler 1 according to the first embodiment is formed such that a side surface of the tubular member 10 is formed to be a curved surface. Still further, when referenced to a plan diagram of FIG. 14 and a bottom diagram of FIG. 15, the tubular member 10 of the muffler 1 according to the first embodiment has a trapezoidal shape.

From the above description, according to the muffler manufacturing method of the first embodiment, the tubular member 10 of the muffler 1 can be formed by only performing a simple bending process by adjusting an advancing direction of the muffler body member 31 into the bending machine by means of the guide 43. That is, according to the muffler manufacturing method of the first embodiment, without using a high-cost winding mold or the like, the tubular member 10 can be formed with a simple method.

Further, according to the muffler manufacturing method of the first embodiment, the tubular member 10 can be formed with a processing method that can complete the process at low cost and in a short period of time such as swaging and the like when the tubular member 10 of the muffler 1 is formed. Therefore, reduction of the processing cost and the processing time can be realized.

Figure 16:
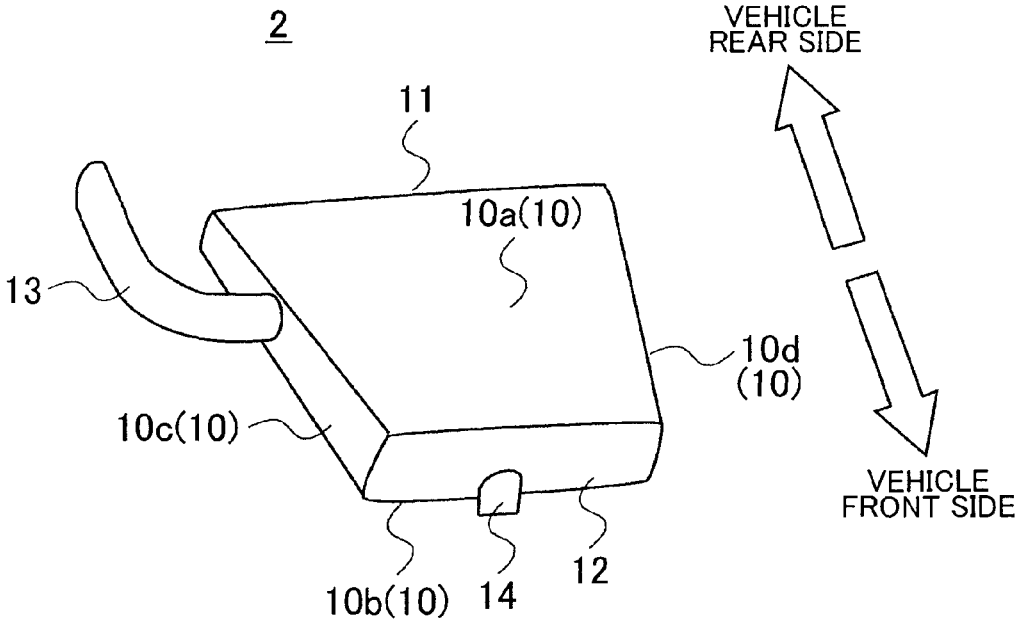
FIG. 16 is a schematic diagram that shows a shape of a muffler according to the second embodiment.

In the second embodiment, a muffler 2 that is an example of a shape different from that of the muffler 1 will be described. FIG. 16 shows a schematic diagram of a shape of the muffler 2 according to the second embodiment. In the description of the second embodiment, the same reference numerals are given to like constituent members as the constituent members of the first embodiment, and description thereof will be omitted.

As shown in FIG. 16, a muffler 2 according to the second embodiment is the same as the first embodiment except that a side surface part is formed into a flat surface. It is also possible to form such a shape by adjusting processing of a side surface part with the bending machine and a control method of the guide 43.

Depending on a shape of the clearance in the vehicle body, capacity can be increased by forming a shape like the muffler 2. Further, even when such a shape is formed, effects of an improvement in the installability and an improvement in the aerodynamic performance the same as that in the first embodiment can be obtained.

Figure 17:
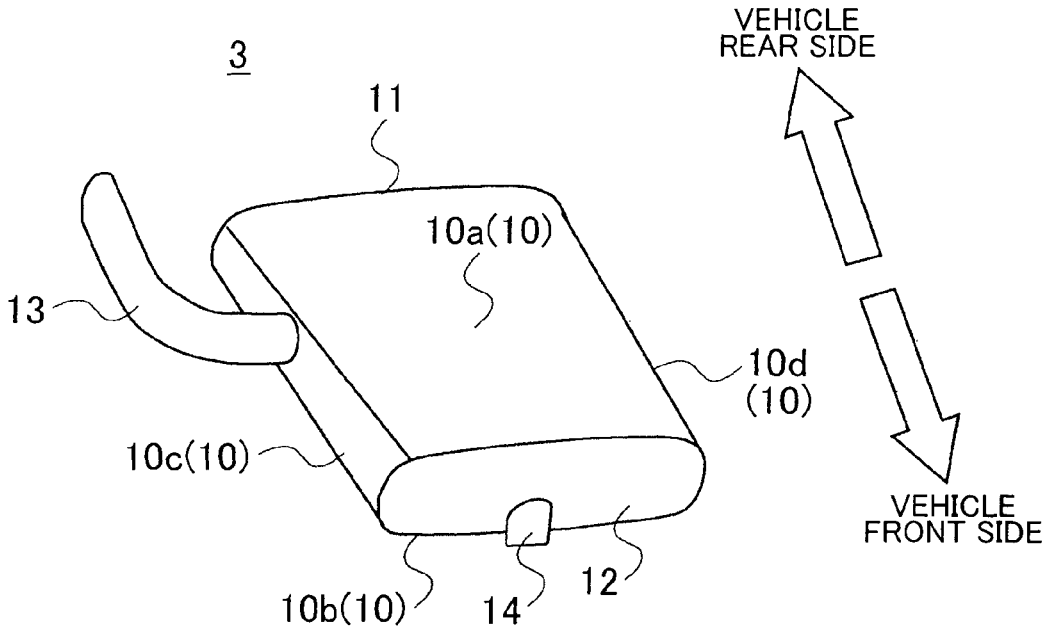
FIG. 17 is a schematic diagram that shows a shape of a muffler according to the third embodiment.

In the third embodiment, a muffler 3 that is an example of a shape different from that of the muffler 1 will be described. FIG. 17 is a schematic diagram that shows a shape of the muffler 3 according to the third embodiment. In the description of the third embodiment, the same reference numerals are given to like constituent members as the constituent members of the first embodiment, and description thereof will be omitted.

As shown in FIG. 17, a muffler 3 according to the third embodiment is formed by making the muffler 1 of the first embodiment asymmetrical between left and right. When the clearance into which a muffler can be installed is formed into left-right asymmetry, the installabilty can be improved the same as that of the muffler 1 of the first embodiment, when a shape of the muffler is formed into left-right asymmetry. Further, when the muffler is formed into left-right asymmetry to match the shape of the clearance, capacity of the muffler can be increased to the maximum.

Figure 18:
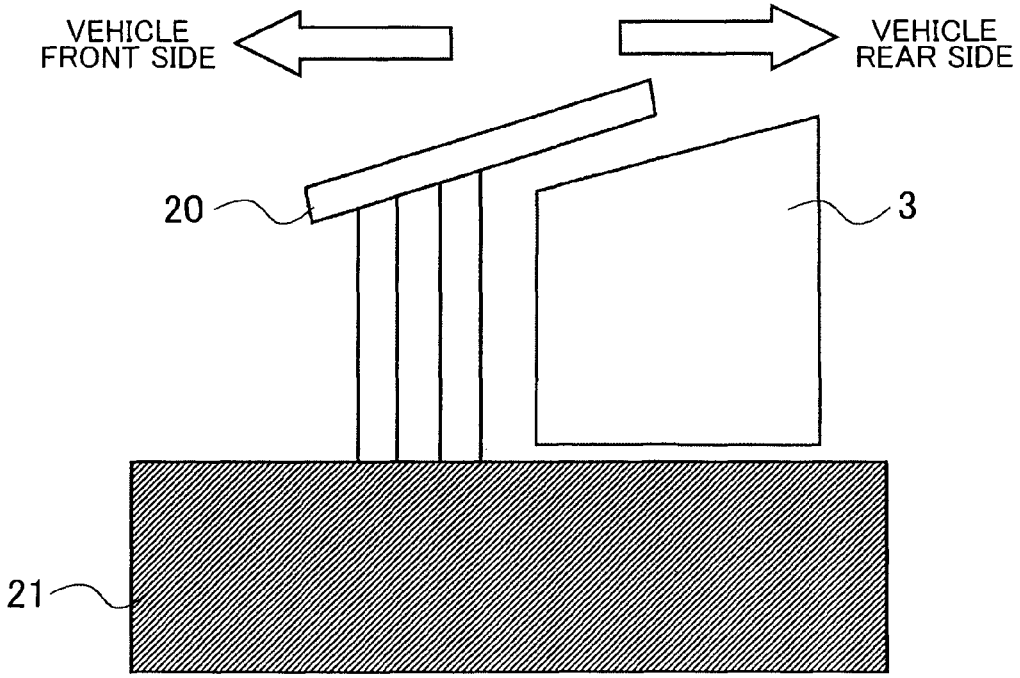
FIG. 18 is a schematic diagram that describes a mounting position of a muffler according to the third embodiment.

Now, a schematic diagram that describes a mounting position of the muffler of the third embodiment is shown in FIG. 18. As shown in FIG. 18, the muffler 3 of the third embodiment has a shape that avoids an under panel 21 disposed under the rear suspension member 20. In the case where other structures such as the under panel 21 are present under the rear suspension member 20, the muffler 1 of the first embodiment may interfere with the under panel 21. However, when the muffler 3 of the third embodiment is used, capacity of the muffler is maximized while avoiding the interference.

The muffler 3 of the third embodiment can be formed into a shape of left-right asymmetry according to a processing method the same as that of the first embodiment by only changing an advancing direction of the muffler body member 31 by means of the guide 43 in the bending process.

Herein, detailed shapes of the muffler 3 according to the third embodiment will be described with reference to FIG. 19 to FIG. 25. In FIG. 19 to FIG. 25, the exhaust pipe 13 and the air intake joint 14 of which shapes can be optionally set in the muffler 3 according to the third embodiment and a rib that can be formed in the manufacturing process are shown with a dash line. Further, in FIG. 19 to FIG. 25, embossed positions of the tubular member 10, the first sealing part 11 and the second sealing part 12 of which shapes can be optionally set are shown with a dash line.

Figure 19:
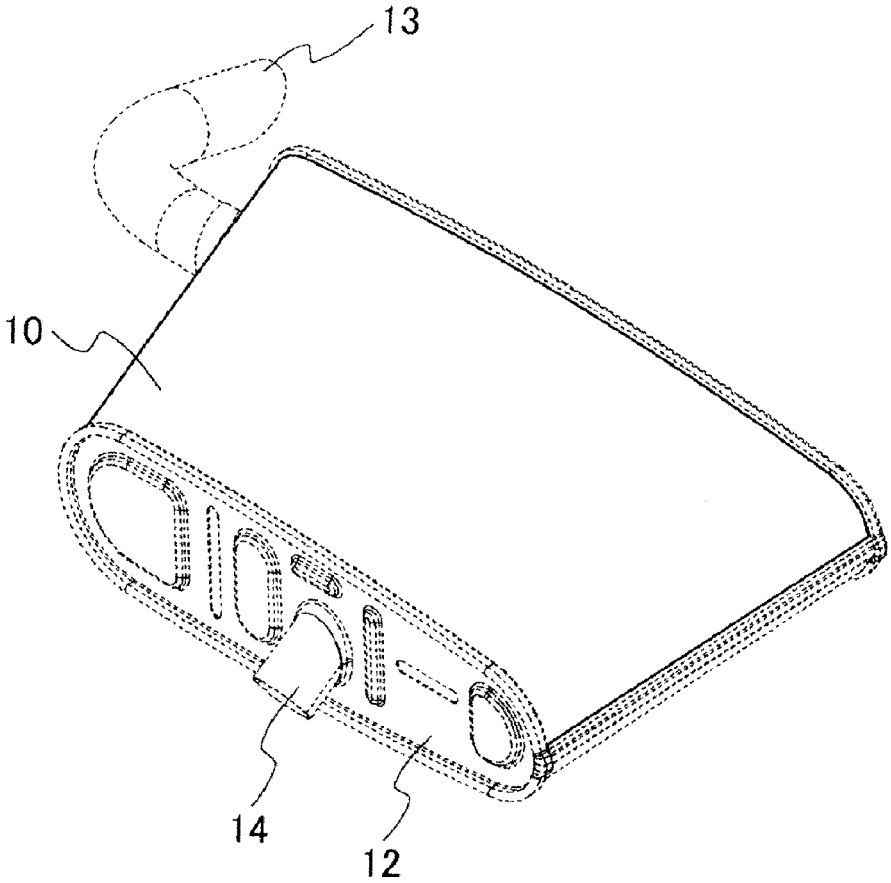
FIG. 19 is a perspective diagram of the muffler according to the third embodiment.
Figure 20:
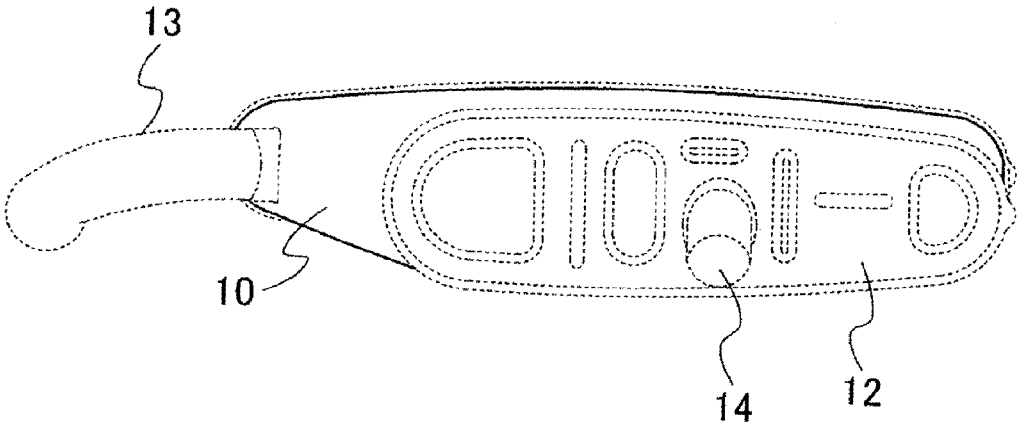
FIG. 20 is a front diagram of the muffler according to the third embodiment.
Figure 21:
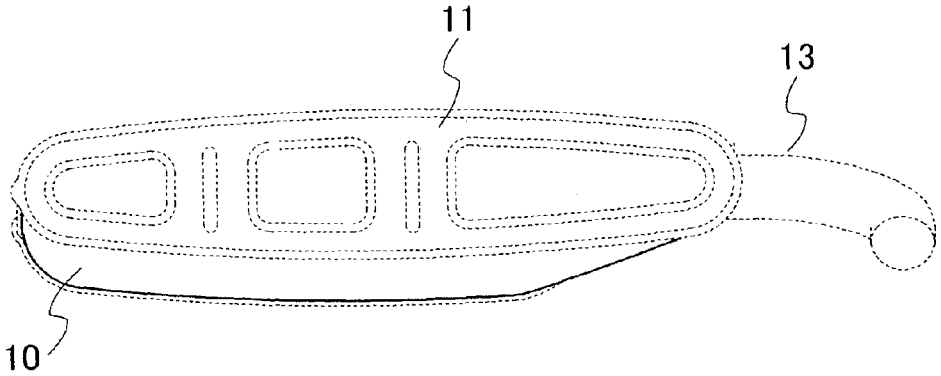
FIG. 21 is a back diagram of the muffler according to the third embodiment.
Figure 22:
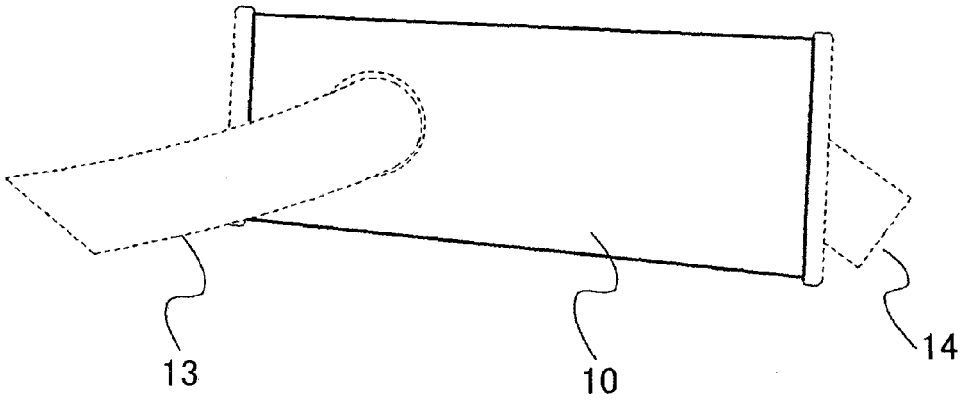
FIG. 22 is a left-side diagram of the muffler according to the third embodiment.
Figure 23:
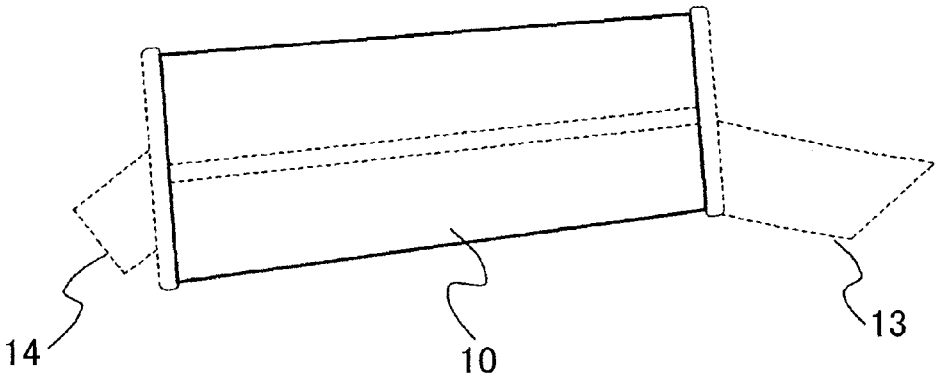
FIG. 23 is a right-side diagram of the muffler according to the third embodiment.
Figure 24:
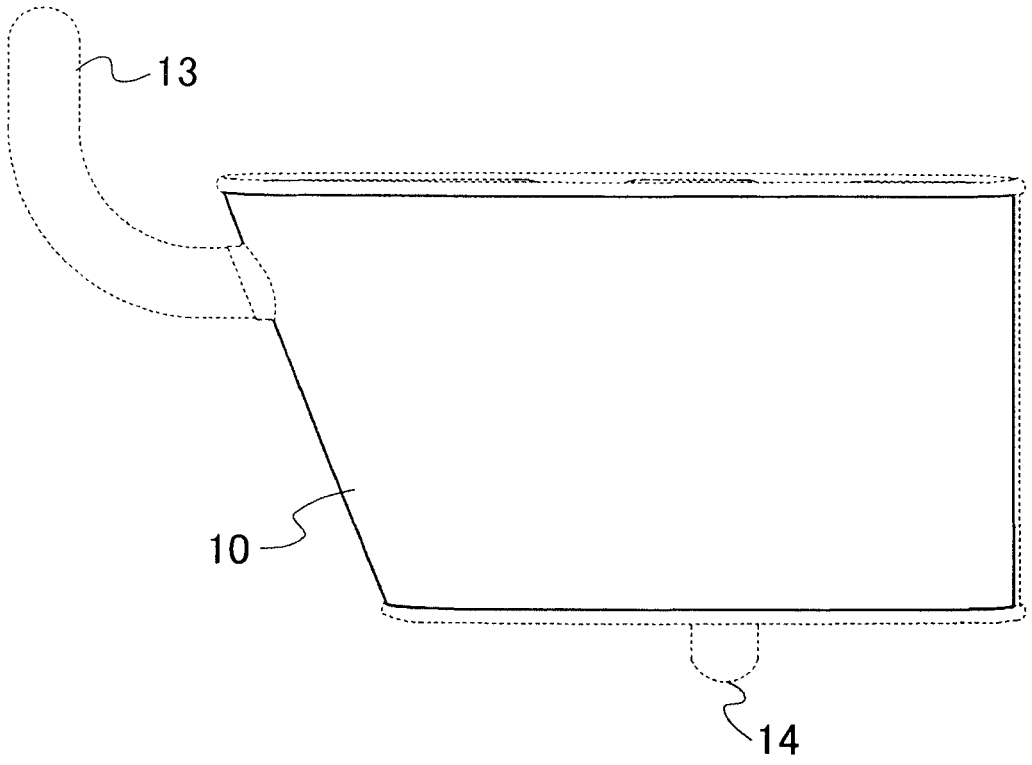
FIG. 24 is a top diagram of the muffler according to the third embodiment.
Figure 25:
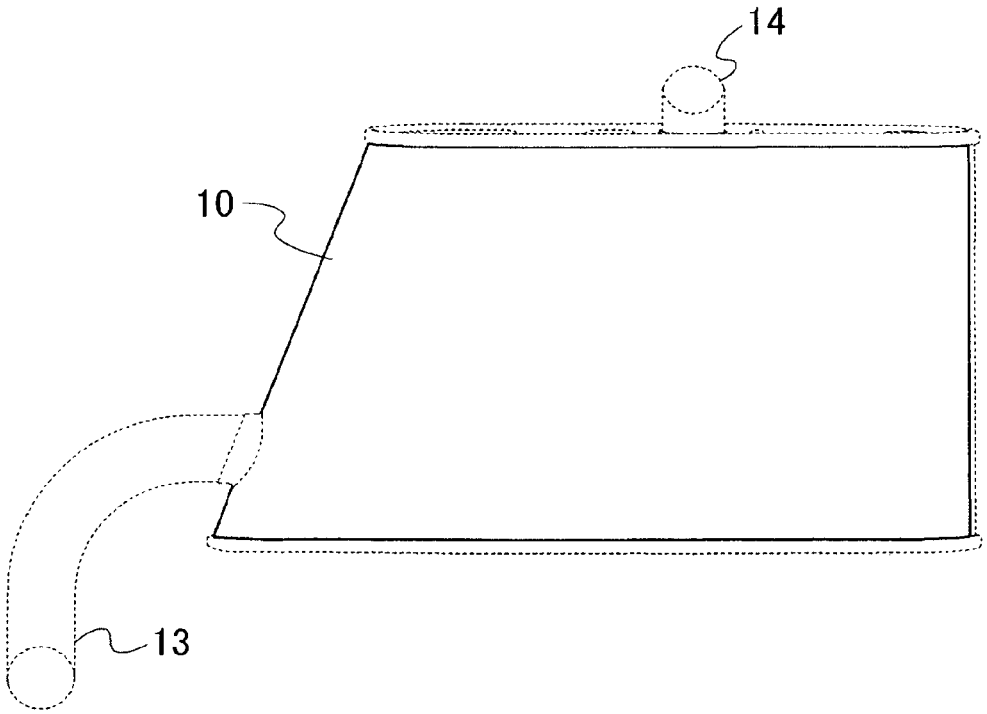
FIG. 25 is a bottom diagram of the muffler according to the third embodiment.

FIG. 19 is a perspective diagram of the muffler 3 according to the third embodiment. FIG. 20 is a front diagram of the muffler 3 according to the third embodiment. FIG. 21 is a back diagram of the muffler 3 according to the third embodiment. FIG. 22 is a left-side diagram of the muffler 3 according to the third embodiment. FIG. 23 is a right-side diagram of the muffler 3 according to the third embodiment. FIG. 24 is a plan diagram of the muffler 3 according to the third embodiment. FIG. 25 is a bottom diagram of the muffler 3 according to the third embodiment.

As shown in FIG. 19 to FIG. 25, the muffler 3 according to the third embodiment has a width (a horizontal direction in the drawing of FIG. 20) of the first sealing part 11 smaller than a width (a horizontal direction in the drawing of FIG. 21) of the second sealing part 12. On the other hand, the muffler 3 according to the third embodiment has a height (a vertical direction in the drawing of FIG. 20) of the first sealing part 11 larger than a height (a vertical direction in the drawing of FIG. 21) of the second sealing part 12. Further, the muffler 3 according to the third embodiment is formed such that a side surface of the tubular member 10 is formed to be a curved surface. Still further, when referenced to a plan diagram of FIG. 24 and a bottom diagram of FIG. 25, the tubular member 10 of the muffler according to the third embodiment has a trapezoidal shape that is unsymmetrical in a horizontal direction.

In the description above, the invention made by the inventors was specifically described on the basis of the embodiments. However, the invention is not limited to the embodiments described above, and it goes without saying that various alterations can be applied within a range that does not deviate from the gist of the invention.

What is claimed is:

1. A manufacturing method for a muffler comprising:

a trimming step of cutting out a dogleg shaped muffler body member from a planar plate, the dogleg shaped muffler body member defining a first part and a second part and a bending portion between the first part and the second part, wherein a length of the bending portion of one side of the dogleg shaped muffler body member is different than a length of an opposing side of the bending portion of the dogleg muffler body member;

a bending processing step of processing the muffler body member into a tube by advancing the muffler body member between an upper roller and a lower roller of a bending machine while adjusting an advancing direction with a guide and by changing a relative position of the upper roller and the lower roller, thereby producing a tubularly-processed muffler body member;

a first joining step of joining two ends of the tubularly-processed muffler body member in a long side direction of the dogleg shaped muffler body member;

an insertion step of inserting an inner structural member to the inside of the tubularly-processed muffler body member;

a second joining step of joining caps to opening portions of the tubularly-processed muffler body member to seal the tubularly-processed muffler body member; and a third joining step of joining an air intake joint and an exhaust pipe to the sealed muffler body member.

2. The manufacturing method according to claim 1, wherein in the first and second joining steps, a swaging process is used to join the two ends of the tubularly-processed muffler body member and join the caps to the opening portions of the tubularly-processed muffler body member.

* * * * *